US005254124A

United States Patent [19]

Heintke et al.

[11] Patent Number: 5,254,124

[45] Date of Patent: Oct. 19, 1993

[54] EPILATION HEAD FOR MOTOR-POWERED EPILATING APPLIANCES

[75] Inventors: Hans-Eberhard Heintke, Wächtersbach; Gebhard Braun, Kelkheim; Walter Schäfer, Frankfurt am Main, all of Fed. Rep. of Germany

[73] Assignee: Braun Aktiengesellschaft, Frankfurt, Fed. Rep. of Germany

[21] Appl. No.: 842,150

[22] PCT Filed: Jun. 22, 1991

[86] PCT No.: PCT/DE91/00512

§ 371 Date: Apr. 2, 1992

§ 102(e) Date: Apr. 2, 1992

[87] PCT Pub. No.: WO92/01405

PCT Pub. Date: Feb. 6, 1992

[30] Foreign Application Priority Data

Jul. 21, 1990 [DE] Fed. Rep. of Germany ..... 4023252

[51] Int. Cl.[5] ..... A45D 26/00

[52] U.S. Cl. ..... 606/133; 606/131

[58] Field of Search ..... 606/131, 133

[56] References Cited

U.S. PATENT DOCUMENTS 4,575,902 3/1986 Alazet .
5,057,116 10/1991 Zucker ..... 606/133
5,084,046 1/1992 Isack ..... 606/133
5,112,342 5/1992 Foerster ..... 606/133
5,116,348 5/1992 Gorter ..... 606/133

FOREIGN PATENT DOCUMENTS 0147285 7/1985 European Pat. Off. .
0247076 12/1987 European Pat. Off. .
0443914 8/1991 European Pat. Off. ..... 606/133
8633290.2 12/1986 Fed. Rep. of Germany .
3922949 7/1989 Fed. Rep. of Germany .
2556939 12/1983 France .
WO87/02556 5/1987 PCT Int'l Appl. .

*Primary Examiner*—Stephen C. Pellegrino
*Assistant Examiner*—Glenn K. Dawson
*Attorney, Agent, or Firm*—Fish & Richardson

[57] ABSTRACT

The invention concerns a hair-plucking head for a motor-driven depilation appliance. The head has a gripping device with at least two diametrically opposed spring-biased gripper jaws which can be pressed against the inside of a hollow cylinder mounted in the casing of the appliance. The jaws operate in conjunction with a control element disposed equiaxially with the cylinder axis. The appliance also has a transmission link between the motor and the cylinder and/or the control element. The jaws are mounted to pivot on pins located inside the cylinder and driven by the control element and a lever assembly.

12 Claims, 5 Drawing Sheets

EPILATION HEAD FOR MOTOR-POWERED EPILATING APPLIANCES

This invention relates to an epilation head for motor-powered epilating appliances, comprising a hollow cylinder which is at least in part enclosed by the appliance casing and whose working surface to be placed in contact with the skin is defined by its end surface, with a gripping device mounted in the hollow cylinder and comprised of at least two diametrically opposed spring-loaded gripping members adapted to be urged into gripping engagement with the inner surface of the hollow cylinder and being operatively associated with a control element disposed equiaxially with the cylinder axis, with a transmission link being provided between the drive motor and the hollow cylinder and/or the control element.

An epilating appliance of the aforementioned type is described in German patent application No. DE 39 22 949. In the epilation head structure described therein in several variants, the gripping members are mounted on the free ends of leaf springs having their other ends attached to the inner surface of the hollow cylinder. The control element which effects the opening or closing movement of the gripping members is configured as a cam acting below the gripping members directly on the leaf springs.

These provisions of the invention assure a precise sequence of motion of the gripping members. Because of the possibility of varying the lever ratios, the energy balance can be favorably affected with regard to the forces to be generated for opening or closing the gripping members and the maintaining of the gripping force in the closed position, as well as with regard to the forces of friction and mass inertia.

The axle arrangement is especially advantageous if it is considered important to have a largely free choice regarding the lever lengths in the direction of the geometrical axis of the cylinder.

A particular axle arrangement affords the advantage of accomplishing a nearly uniform opening space as the gripping members open or, where necessary, an opening space enlarged in the form of a wedge by displacement of the fulcrum of the gripping members, thus facilitating the guiding of the hairs into the gripping space. In addition, it enables the length of the epilation head to be reduced appreciably in the direction of the cylinder axis.

When the gripping members are normally urged into their closed position, the opening movement occurring by the control element in opposition to the spring force. Accordingly, only this action requires energy to be expended. In particular the opening movement can be accelerated by suitably forming the control element (cam or cam disk).

A particular operating mechanism for the gripping members combines the advantages of a particularly straightforward construction with quiet running and energy savings. Conversely to the embodiments previously referred to, the supply of energy for operation of the gripping members in an appreciable amount is only necessary in the range of closed gripping members, while the functions "Open—Keep Open—Close" require forces of friction and mass inertia to be overcome which, however, can be maintained at a low level by technical means known in the art.

Another advantageous embodiment of an epilation head has a mechanism for movement of the gripping members which incorporates essential advantages of the variants previously described, including: Full closing force over the entire range of the closing angle of the control element at low levels of energy consumption. Energy for operation of the gripping members is needed only for the duration of the closing action, that is, the plucking action. It is proportional to the actual gripping force which, in turn, is directly dependent on the force of the spring in the gripping member-and-lever assembly and can be easily held within close limits. The additional spring travel made possible due to the restricted relative movability of the two components is only needed to compensate for manufacturing tolerances, being irrelevant in respect of a force increase.

Embodiments of the present invention are illustrated in the accompanying drawings.

Figure 1:
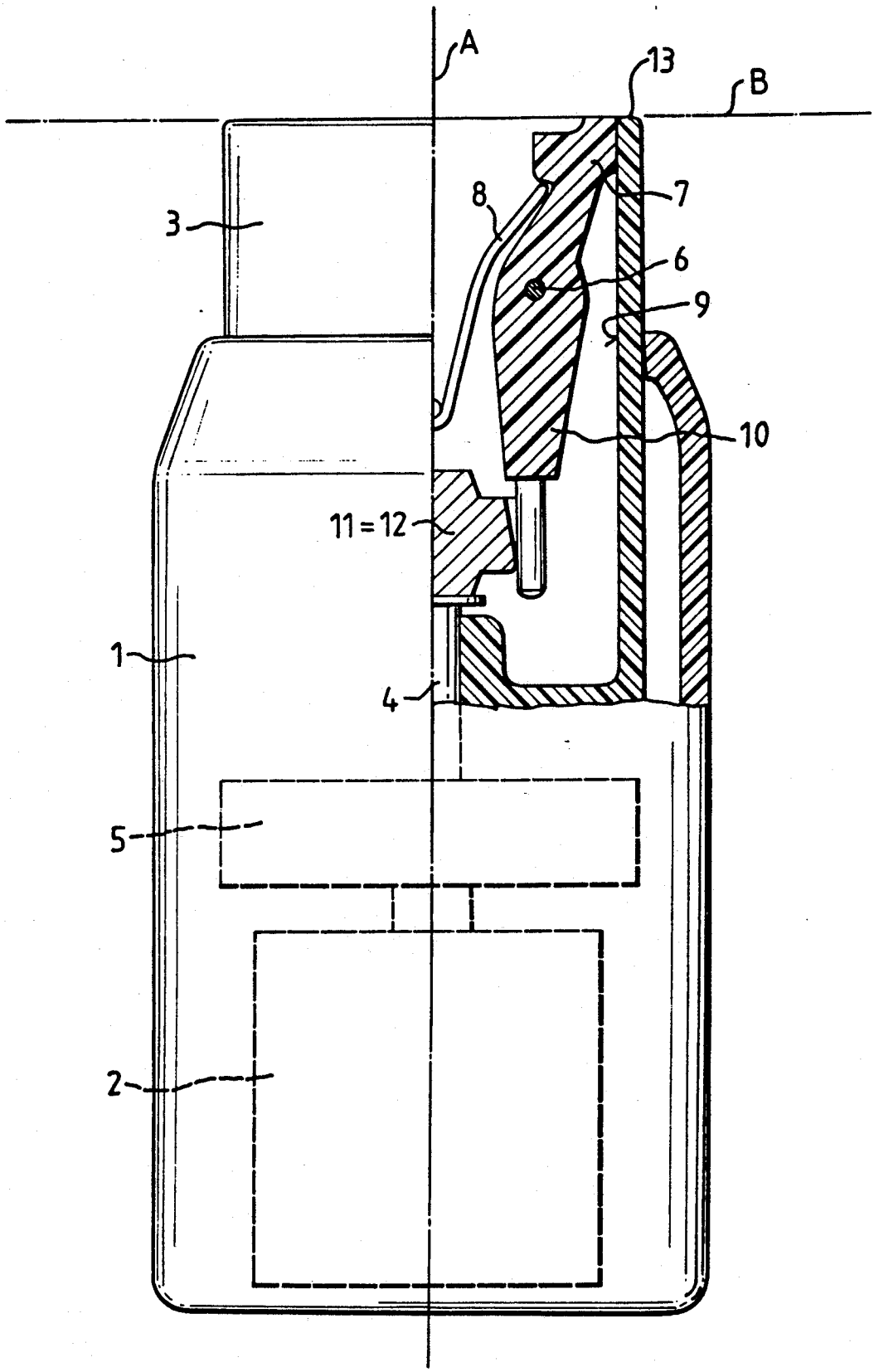
FIG. 1 is a view of an epilating appliance illustrating partly in section an epilation head and schematically the components in the appliance casing.

The epilating appliance illustrated in FIG. 1 is essentially comprised of a casing 1 accommodating a motor 2 illustrated schematically which may be an electric motor supplied with energy from primary or secondary cells or directly from the mains supply, or alternatively, a spring motor.

The casing 1 further embraces part of a hollow cylinder 3 which is part of the epilation head and may be fixedly mounted in the interior of the casing 1 or, alternatively, rotatably carried therein, as described in patent application No. DE 39 22 949.

Coaxially with the geometrical axis A of the hollow cylinder 3, a shaft 4 is rotatably mounted in the casing 1, the shaft being driven by a motor 2 through a transmission mechanism 5 illustrated schematically; optionally, this transmission mechanism 5 may also be used for driving the hollow cylinder 3. Where a stationary axle is used in lieu of the shaft 4, the link to the transmission mechanism 5 is omitted.

In the interior of the hollow cylinder 3, diametrically opposed gripping members 7 are pivotally mounted on fixed axles 6, the gripping members bearing with one end against an inner surface 9 of the hollow cylinder 3 under the action of a spring 8, while their other ends cooperate via lever arms 10 with a control element 11 which may be configured as a cam 12 and is mounted on the shaft (or axle) 4.

For convenience of illustration, FIG. 1 shows only one half of the diametrically opposed gripping member-and-spring assembly arranged in mirror-image relationship to each other.

The periphery 13 of the hollow cylinder 3 with which the epilating appliance is placed on the skin forms the end surface of the epilation head, thus defining its working surface B.

The various possibilities of locating or driving the hollow cylinder 3 and the shaft 4 of the control element 11 being described in patent application No. DE 39 22 949 initially referred to, they will not be explained in greater detail in the following.

Figure 2:
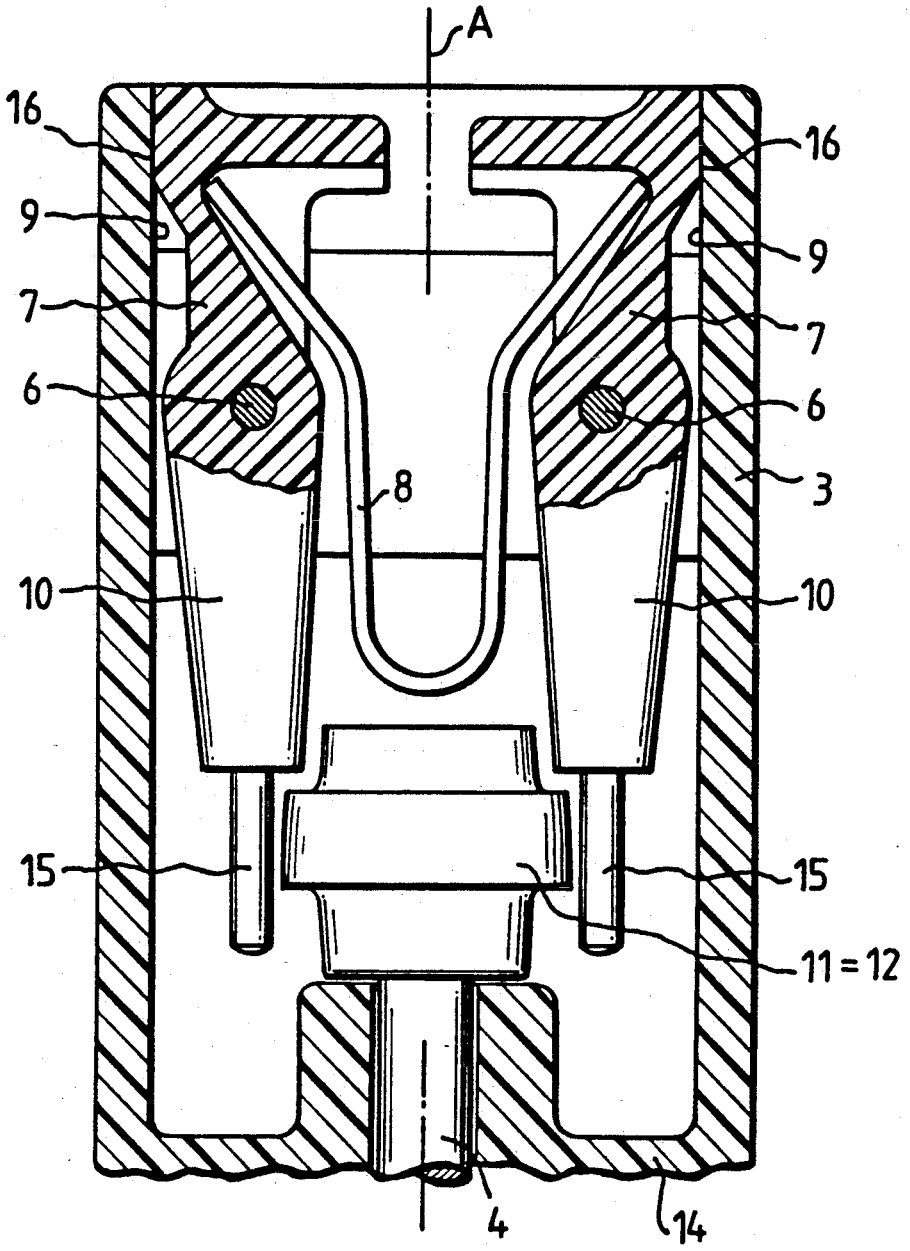
FIG. 2 is a longitudinal sectional view of the epilation head illustrating a first embodiment thereof.

In the epilation head illustrated in FIG. 2, the hollow cylinder 3 has at its bottom a transverse partition 14 through which the shaft (or axle) 4 of the control element 11 extends which in this embodiment is configured as a cam 12. Above the cam 12, when viewed in the direction of the end surface of the hollow cylinder 3, the hollow cylinder receives two axles 6 arranged at right angles and in a mirror-image relationship to the cylinder axis A, with two diametrically opposed gripping members 7 being pivotally mounted thereon. In the direction of the casing interior, the gripping members 7 are provided with lever arms 10 having free ends 15 acting in conjunction with the cam 12. Seated between two gripping members 7 is a compression spring 8 in the form of a bending leg spring urging the gripping members 7 into the closed position by abutting engagement with the inner surface 9 of the hollow cylinder 3 in the upper area thereof.

For the duration of a cycle of operation, the gripping members 7 are urged into the open position by the revolving or stationary cam 12 engaging the lever arms 10 and, on disengagement of the cam 12, are pivoted back to their closed position by the action of the spring 8. A favorable mechanical construction is realizable by the provision of a suitable lever ratio of the gripping members 7 formed by the relative distance of the pivot axle 6 and the point of force application to the cam on the one side, and the gripping surface in the upper area 16 of the hollow cylinder 3 on the other side. Because the gripping members 7 are opened by the cam 12 whereas they are closed by spring force, the closing movement may be performed at an extremely high speed by providing the cam 12 with a suitable profile. This allows correspondingly longer periods for the hair engaging and plucking actions during a working cycle, and the spring-actuated gripping members 7 experience a high initial closing force whereby a secure grip upon the hairs is assured.

Figure 3:
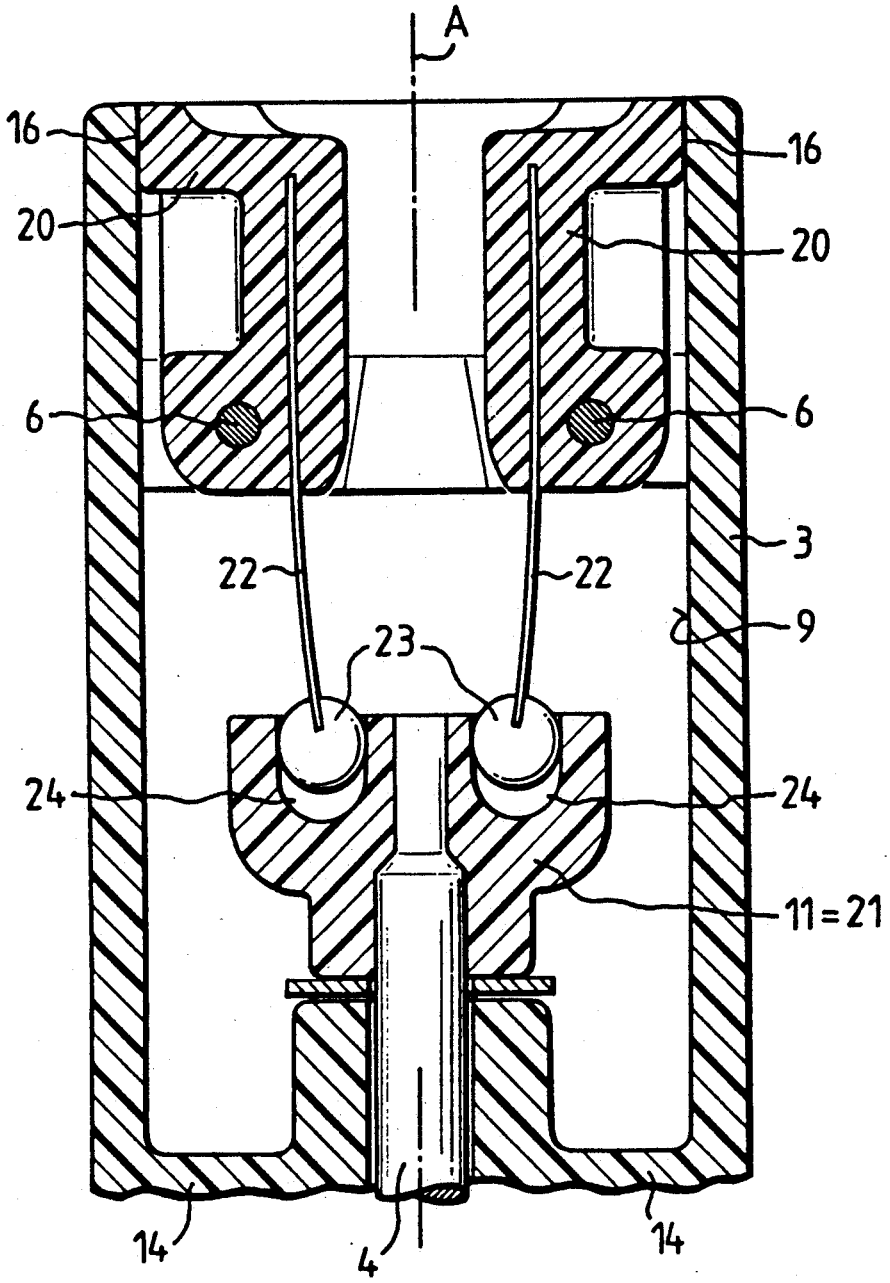
FIG. 3 is a longitudinal sectional view of the epilation head illustrating a second embodiment thereof.

In the variants of the epilation head subsequently described, the configurations of the hollow cylinder 3 and the shaft or axle 4 are unchanged, being identified by like reference numerals. The variant of the epilation head shown in FIG. 3 includes a hollow cylinder in which two axles 6 are arranged in the same manner as in FIG. 2 and have pivotally mounted thereon gripping members 20 engaging the inner surface 9 of the hollow cylinder 3 in the upper area 16 thereof. The shaft (or axle) 4 extending through the transverse partition 14 of the hollow cylinder 3 carries at its free end the control element 11 which in this embodiment is configured as a cam disk 21. Firmly embedded in the gripping members 20 are leaf springs 22 having spherical sliding means 23 at their respective free ends for engagement in the control groove 24 of the cam disk 21.

The leaf spring 22 thus combines in a single component the function of spring action with the function of the transmission of motion from the control element 11 to the gripping member 20, while in the embodiment of FIG. 2 these two functions were distributed to two components. In a working cycle, with the entire system rotating, the cam disk 21 which is at rest or rotating at a suitable speed causes pivotal movement of the gripping members 20 under the action of the bending spring 22. Subsequent to the closing of the gripping space between the gripping members 20 and the meeting area 16 of the inner surface 9 of the hollow cylinder 3, pressing over of the leaf springs 22 produces the gripping force for securely holding the hairs and assuring the grip for the duration of the necessary angle of rotation.

Figure 4:
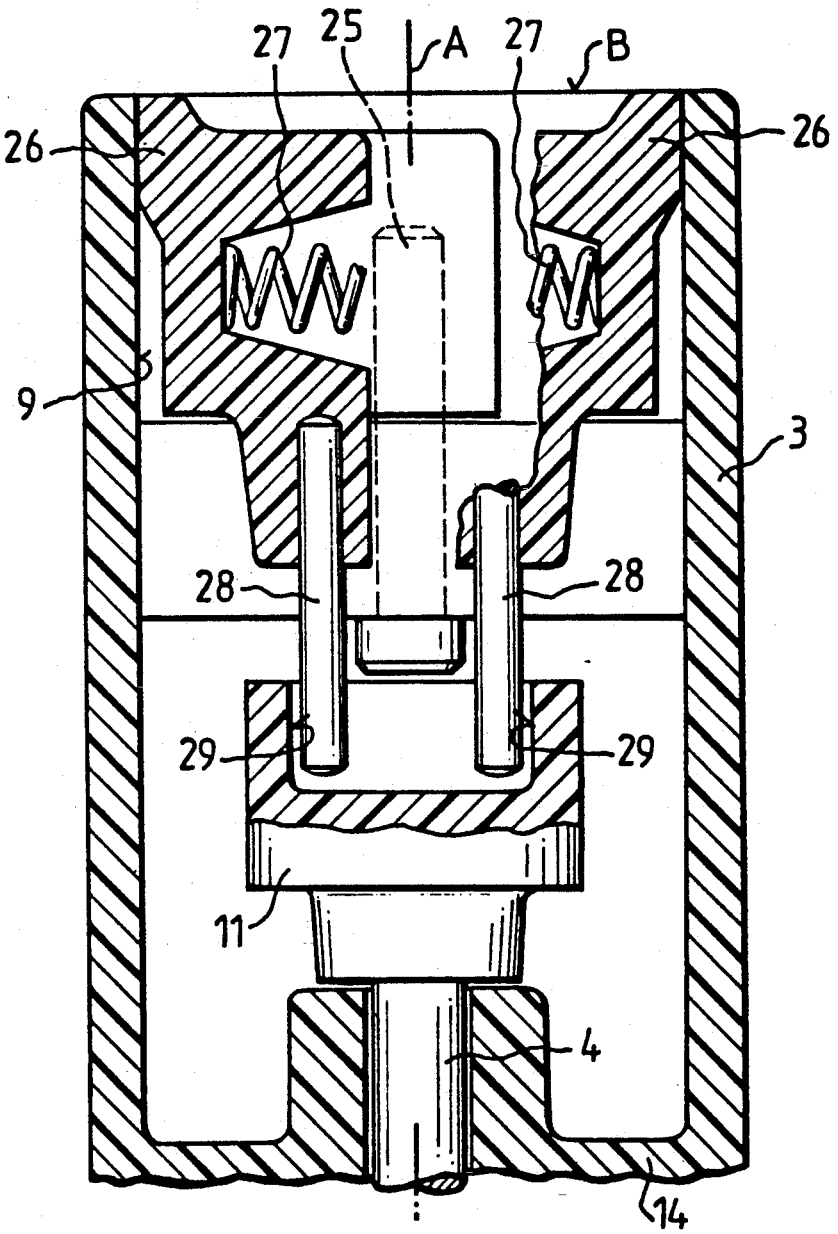
FIG. 4 is a longitudinal sectional view of the epilation head illustrating a third embodiment thereof.
Figure 5:
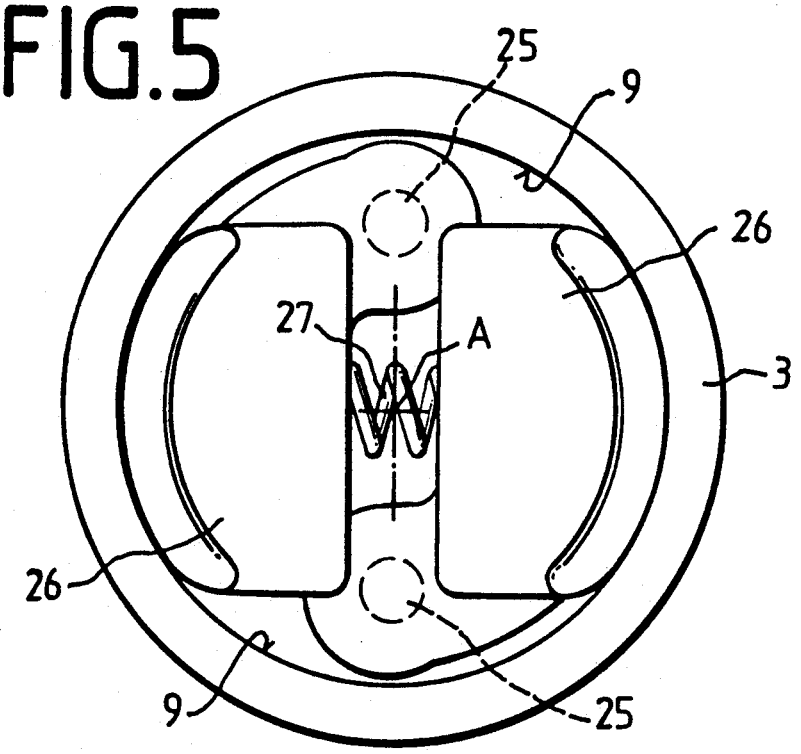
FIG. 5 is a top plan view of the epilation head of FIG. 4.

In the epilation head of FIGS. 4 and 5, the hollow cylinder 3 accommodates two axles 25 extending parallel to the geometrical axis A of the cylinder and having pivotally mounted thereon the gripping members 26, such that the pivotal movement occurs in a direction parallel to the working surface B of the epilation head. FIG. 4 shows only one axle 25. A helical spring 27 seated between the two gripping members 26 urges the two gripping members 26 into the closed position in which they are in engagement with the inner surface 9 of the hollow cylinder 3. The gripping members 26 are provided with respective lever arms 28 cooperating with the control element 11 mounted on the shaft (or axle) 4, the control element being in this embodiment of a cup-shaped configuration having an inner surface 29 serving as a control cam against which the lever arms 28 abut at least during the pivotal movement of the gripping members 26.

With the gripping members 26 arranged in this manner and the clearance between the members dimensioned as herein provided, a nearly uniform opening space results between the gripping members 26 and the inner surface 9 of the hollow cylinder 3. Where necessary, however, an opening space enlarged in the form of a wedge may be accomplished by relocating the pivot axles 25 from the position shown in FIG. 5 while the dimensions of the gripping members 26 are maintained, in order to facilitate the guiding of the hairs to be plucked into the gripping space.

Figure 6:
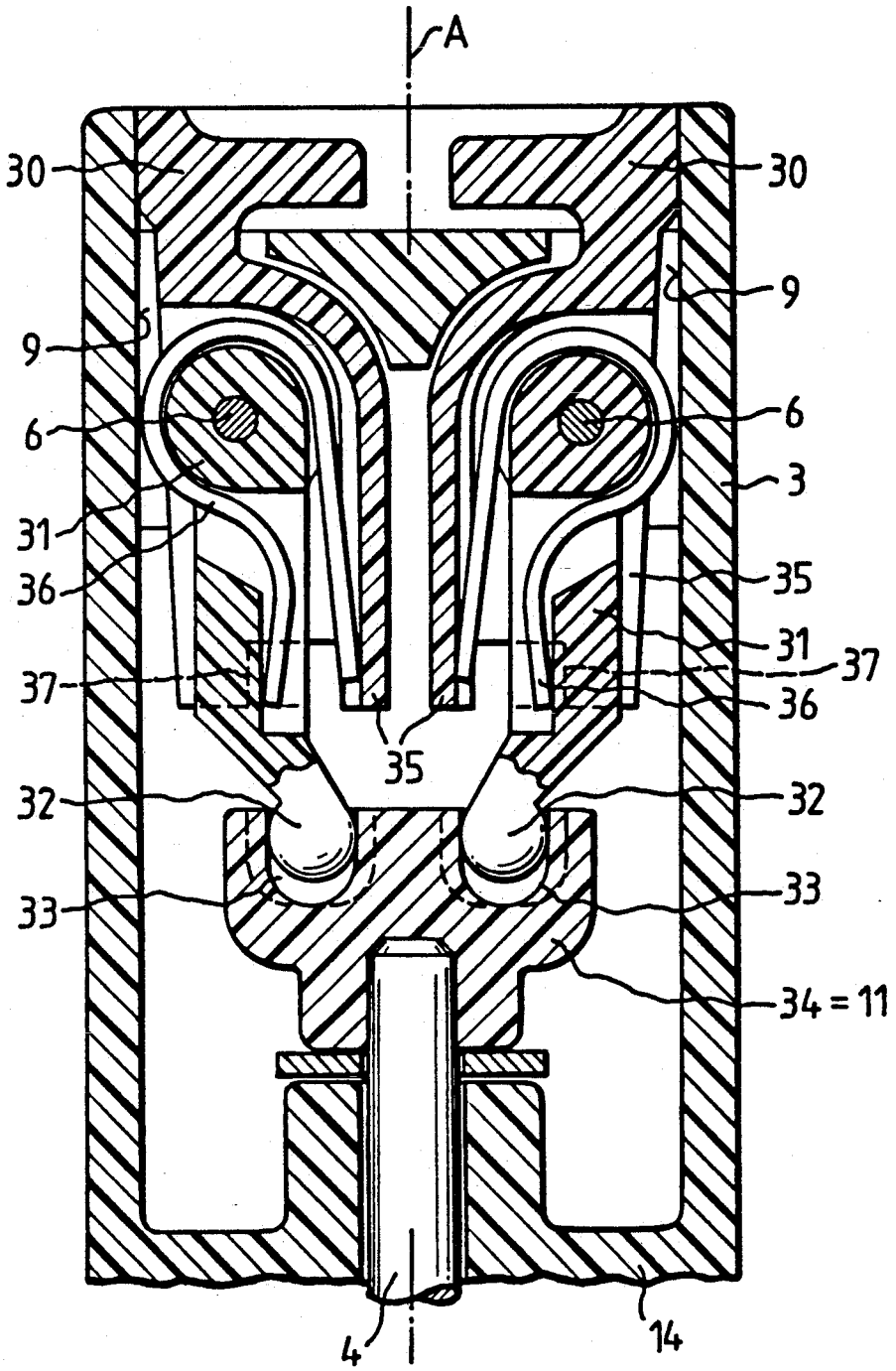
FIG. 6 is a longitudinal sectional view of the epilation head illustrating a fourth embodiment thereof.

The embodiment of the epilation head illustrated in FIG. 6 equally includes a transverse partition 14 through which the shaft (or axle) 4 extends, and two axles 6 disposed in the upper portion of the hollow cylinder 3 at right angles to the geometrical axis A of the hollow cylinder 3. Mounted on these axles are both gripping members 30 and separate lever arms 31 initially independent thereof, thus allowing their relative rotational movement. The lever arms 31 have at their free ends respective spherical sliding members 32 formed integral therewith and engaging in the control groove 33 of a cam disk 34 mounted on the shaft (or axle) 4, the cam disk representing the control element 11 in this embodiment.

The gripping members 30 have each a hood-type extension 35 embracing part of the lever arms 31. Seated between the two components is a spring 36 in the form of a bending leg spring embracing the associated axle 6 and urging the gripping members 30 and the associated lever arms 31 apart until the lever arms 31 are in abutting engagement with recesses providing abutment stops 37 in the hood-shaped extension 35.

In this abutment position which is illustrated in FIG. 6 and in which the gripping space between the gripping members 30 and the inner surface 9 of the hollow cylinder 3 is closed, the assembly comprising the gripping members 30, the spring 36 and the lever arm 31 constitutes a complete functional unit operated by the control groove 33 of the cam disk 34 as follows:

Operating in synchronism with the relative movement of the cam disk 34 and the lever arm 31, the gripping space will open from the closed position shown in the drawing up to a maximum width which is maintained constant over an angle of rotation determined by the profile of the control groove 33; the succeeding closing action is performed through the lever arm 31 until the gripping members 30 have again reached the closed position shown. As the closing movement proceeds, the lever arm 31 moves away from the abutment stop 37 in the direction of the geometrical axis A of the hollow cylinder 3, with the gripping members 30 maintaining the full closing force on the gripping space over the entire range of the closing angle. In the further sequence, the control element 11 returns the lever arm 31 into engagement with the abutment stop 37, starting a new working cycle.

We claim:

1. An epilating appliance comprising a casing, an epilation head and a drive motor operatively attached to said epilation head, said epilation head comprising hollow cylinder structure which is at least in part enclosed by the appliance casing, said cylinder structure having an inner surface and an open end that defines a working surface (B) to be placed in contact with the skin, axle structure in said hollow cylinder structure, gripping structure mounted in said hollow cylinder structure and comprised of at least two diametrically opposed gripping members pivotally mounted on said axle structure and adapted to be urged into gripping engagement with said inner surface of said hollow cylinder structure, control structure disposed equiaxially with a geometrical axis (A) of said cylinder structure, a transmission link coupled to said drive motor for producing relative movement between said hollow cylinder structure and said control structure, and a lever arrangement responsive to said control structure and coupled to said gripping members for driving said gripping members.

2. The epilating appliance of claim 1 wherein said axle structure is disposed at right angles to said geometrical axis (A) of said cylinder structure.

3. The epilating appliance of claim 1 wherein said axle structure is disposed parallel to said geometrical axis (A) of said cylinder structure.

4. The epilating appliance of claim 1 and further including common compression spring structure disposed between said two opposed gripping members, and wherein each said gripping member includes a lever arm of said lever arrangement that extends parallel to said geometrical axis (A) and cooperates with said control structure.

5. The epilating appliance of claim 4 wherein said axle structure is disposed at right angles to said geometrical axis (A) of said cylinder structure.

6. The epilating appliance of claim 5 wherein each said lever arm has a free end, and said control structure includes a cam member for positive engagement with said free ends of said lever arms.

7. The epilating appliance of claim 4 wherein said axle structure is disposed parallel to said geometrical axis (A) of sad cylinder structure.

8. The epilating appliance of claim 1 wherein each said gripping member is provided with a leaf spring extending substantially parallel to said geometrical axis (A) and serving as a lever arm, each said spring having a free end cooperating with sad control structure.

9. The epilating appliance of claim 8 wherein said axle structure is disposed at right angles to said geometrical axis (A) of said cylinder structure.

10. The epilating appliance of claim 1 wherein each said gripping member has separate lever arm structure that is pivotally mounted on said axle structure and is relatively movable within limits, and a spreader spring is seated between each said lever arm structure and its associated gripping member.

11. The epilating appliance of claim 10 wherein said axle structure is disposed at right angles to said geometrical axis (A) of said cylinder structure.

12. The epilating appliance of claim 1 wherein gripping structure includes a lever arm associated with each said gripping member, each said lever arm has a free end, and said control structure includes a cam member for positive engagement with said free ends of said lever arms.

* * * * *